US009206592B2

(12) United States Patent
Coronado

(10) Patent No.: US 9,206,592 B2
(45) Date of Patent: Dec. 8, 2015

(54) TOILET INSTALLATION AID

(71) Applicant: Coflex S.A. de C.V., Monterrey, Nuevo Leon (MX)

(72) Inventor: Eduardo Coronado, San Pedro Garza Garcia (MX)

(73) Assignee: COFLEX S.A. DE C.V. (MX)

( * ) Notice: Subject to any disclaimer, the term of this patent is extended or adjusted under 35 U.S.C. 154(b) by 184 days.

(21) Appl. No.: 14/161,953

(22) Filed: Jan. 23, 2014

(65) Prior Publication Data

US 2015/0167285 A1 Jun. 18, 2015

Related U.S. Application Data

(60) Provisional application No. 61/915,852, filed on Dec. 13, 2013.

(51) Int. Cl.
*E03D 11/00* (2006.01)
*E03D 11/14* (2006.01)
*E03D 11/16* (2006.01)

(52) U.S. Cl.
CPC ..... *E03D 11/16* (2013.01)

(58) Field of Classification Search
CPC ..... E03D 11/02; E03D 11/16; E03D 11/17; F16L 17/025; F16L 17/03
USPC ..... 4/252.1–252.6, 661; 285/56; 33/529, 33/703, 732
See application file for complete search history.

(56) References Cited

U.S. PATENT DOCUMENTS 1,042,087 A * 10/1912 Clifford ..... E03D 11/16 285/349
1,090,517 A * 3/1914 Crosby ..... E03D 11/16 285/328
5,335,849 A * 8/1994 Forbes ..... E03D 11/16 285/12
6,128,947 A * 10/2000 Anderson, Sr. ..... G01M 3/042 73/40
9,091,076 B2 * 7/2015 Amer ..... E04F 21/0076
2003/0126676 A1 * 7/2003 Gallacher ..... E03D 11/16 4/252.5
2005/0108814 A1 * 5/2005 Thompson ..... E03D 11/17 4/252.6
2012/0079649 A1 * 4/2012 Edwards ..... E03D 11/16 4/252.6
2013/0167292 A1 * 7/2013 McHugh, III ..... E03D 11/16 4/252.4
2013/0227772 A1 * 9/2013 Schuster ..... E03D 11/17 4/300
2014/0230361 A1 * 8/2014 Wood ..... E04F 1/0076 52/747.11
2015/0135421 A1 * 5/2015 Guthrie ..... E03D 11/16 4/252.6
2015/0159359 A1 * 6/2015 Halloran ..... E03D 11/16 4/420

* cited by examiner

*Primary Examiner* — Kevin P Shaver
*Assistant Examiner* — Benjamin R Shaw
(74) *Attorney, Agent, or Firm* — Baker & McKenzie LLP

(57) ABSTRACT

A toilet installation aid that allows a user to determine the amount of gapping between a top surface of a toilet flange and a bottom surface of a toilet bowl. The toilet installation aid indicates the number and/or size of toilet seals needed to create a proper seal between the toilet flange and the toilet bowl. The toilet installation aid indicates if a toilet flange should be raised or if one or more spacers is needed to create a seal between a toilet bowl and the toilet flange.

20 Claims, 8 Drawing Sheets

TOILET INSTALLATION AID

CROSS-REFERENCE TO RELATED APPLICATIONS

This application claims priority to U.S. Provisional Patent Application No. 61/915,852 entitled "Toilet Installation Aid" filed on Dec. 13, 2013, which are incorporated herein by reference in its entirety.

TECHNICAL FIELD

The present disclosure relates generally to a toilet installation aid, and more particularly to a toilet installation aid that determines the amount of gapping between a top surface of a toilet flange and a bottom surface of a toilet bowl.

BACKGROUND

Toilets, also called water closets, are waste disposal devices commonly installed in most bathrooms. These kinds of plumbing appliances generally include a water-storing receptacle called a water tank that is attached to a siphon seat-shaped bowl called a toilet bowl. Periodically, waste is removed from the toilet bowl by flushing, thereby allowing water to drain from the water tank through the toilet bowl and into a waste drainpipe. In order to work, however, the toilet bowl must be connected to the waste drainpipe by fluid carrying conduits. Typically, the toilet bowl will sit flat on a floor and connect with a toilet flange. The toilet flange in turn connects with conduits leading to a waste drainpipe.

In order to create a proper seal between the toilet flange and the toilet bowl, one or more toilet seals may be needed. These toilet seal are typically made from foam, wax, or rubber and may be shaped as a ring. Because of the unique nature of each toilet installation, a different number of toilet seals may be needed for each installation. For example, depending on when and where the toilet was installed, an outer lip of the toilet flange may rest on either a finished flooring surface or on a sub-flooring surface. If the outer lip of the toilet flange rests on the finished flooring surface, only one toilet seal may be needed, depending on the shape of the toilet being installed. However, if the outer lip of the toilet flange rests on the sub-flooring surface, one or more additional toilet seals may be needed to compensate for the thickness of the finished flooring surface and to create a proper seal between the toilet bowl and the toilet flange.

When connecting the toilet bowl to the toilet flange, an outer, decorative portion of the toilet bowl will sit on the flooring surface and will obstruct any view of the connection between an inner portion of the toilet bowl and the toilet flange. Therefore, a user, whether a plumbing professional or a do-it-yourself (DIY) homeowner, often must guess as to the number, thickness, and/or type of toilet seals required to create a proper seal between the toilet bowl and the toilet flange and even after installing the toilet would not know if a proper seal has been made.

Thus, a toilet installation aid that can be used to quickly and easily determine the number and/or thickness of toilet seals needed to create a proper seal between the toilet bowl and toilet flange is desired.

BRIEF SUMMARY

In an exemplary embodiment, a toilet installation aid for determining the amount of a gap between a top surface of a toilet flange and a bottom surface of a toilet. The toilet installation aid can then be used to determine what size and/or quantity of seals are needed to create a suitable seal between the toilet flange and the toilet. The toilet installation aid can also be used to determine if a toilet flange should be raised or if one or more spacers is needed to create a seal between a toilet bowl and the toilet flange.

BRIEF DESCRIPTION OF THE DRAWINGS

Reference is now made to the following descriptions taken in conjunction with the accompanying drawings.

DETAILED DESCRIPTION

Various aspects of a drainage fitting and related methods for installing a drainage fitting according to the present disclosure are described. It is to be understood, however, that the following explanation is merely exemplary in describing the devices and methods of the present disclosure. Accordingly, any number of reasonable and foreseeable modifications, changes and substitutions are contemplated without departing from the spirit and scope of the present disclosure.

Figure 1:
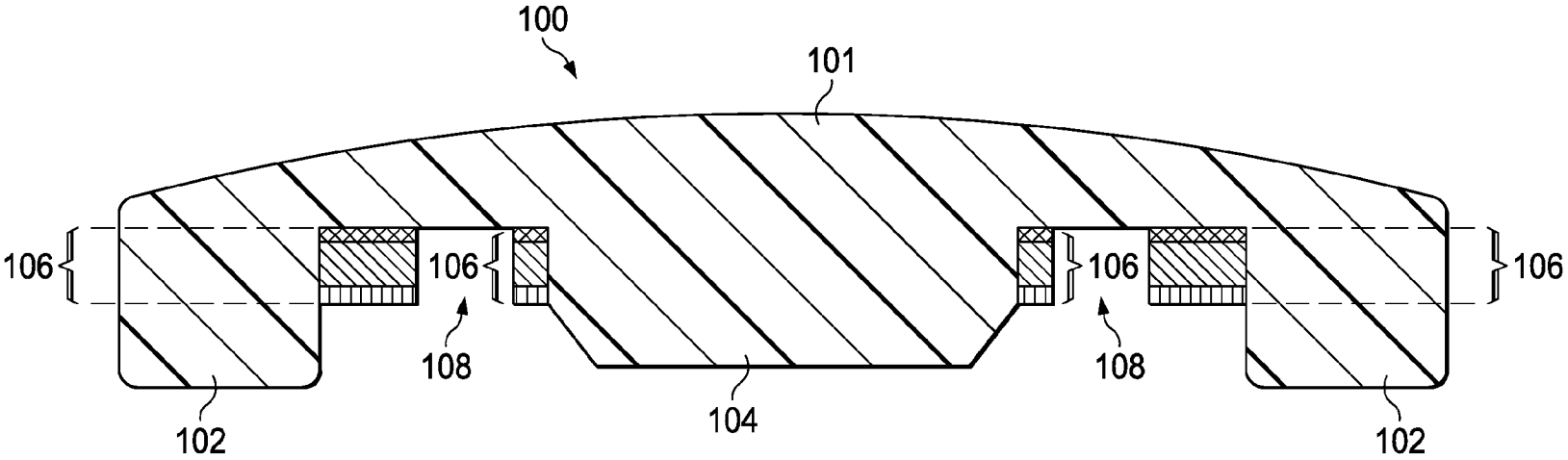
FIG. 1 depicts a front view of a full toilet installation aid in accordance with one embodiment of the present disclosure.

FIG. 1 depicts a front view of a full toilet installation aid 100 in accordance with one embodiment of the present disclosure. The full toilet installation aid 100 may comprise a generally rectangular shaped body 101 operable to allow a user to determine what size and/or quantity of toilet seals are needed to create a suitable seal between a toilet flange and a toilet bowl. Extending from the body 101, the full toilet installation aid 100 may comprise two outer protrusions 102 and an inner protrusion 104. The two outer protrusions 102 may each extend from one end of a lower surface of the body 101 while the inner protrusion 104 may extend from a middle section of the lower surface of the body 101. The outer protrusions 102 and the inner protrusion 104 may be separated from each other by notches 108 extending partially within the body 101. The outer protrusions 102 may be operable to rest on a surface of a finished floor, while the inner protrusion 104 may be operable to be received within a central opening of the toilet flange (not shown).

Surrounding the notches 108 on each side, the body 101 may comprise a plurality of indicators 106 that assist the user in determining the size and/or quantity of seals need to created a suitable seal between the toilet flange and the toilet. As shown in FIG. 1, the indicators 106 may comprise colored markings on the outer protrusions 102 and the inner protrusion 104 proximate to the notches 108. The indicators 106 may be spaced a predetermined distance from a lower edge of the outer protrusions 102 so that the indicators 106 indicate a distance from the surface of a finished floor when the toilet installation aid 100 is in use. The colored markings may comprise one or more colors that indicate zones of no seal (lower zone), perfect seal (middle zone), or excessive compression (upper zone) of the toilet seals when the toilet flange and the toilet bowl are connected.

The full toilet installation aid 100 may be used by home owners and do-it-yourself (DIY) installers who have less experience installing toilets than a professional plumber. The two outer protrusions 102 may allow the user to rest each outer protrusion 102 on the surface of the finished floor, thereby minimizing wobble of the full toilet installation aid 100. Further, the plurality of indicators 106 may allow the user to look at the markings from several different angles so that the user may be sure when determining the size and/or number of seals required for a proper seal between the toilet flange and the toilet.

Figure 2:
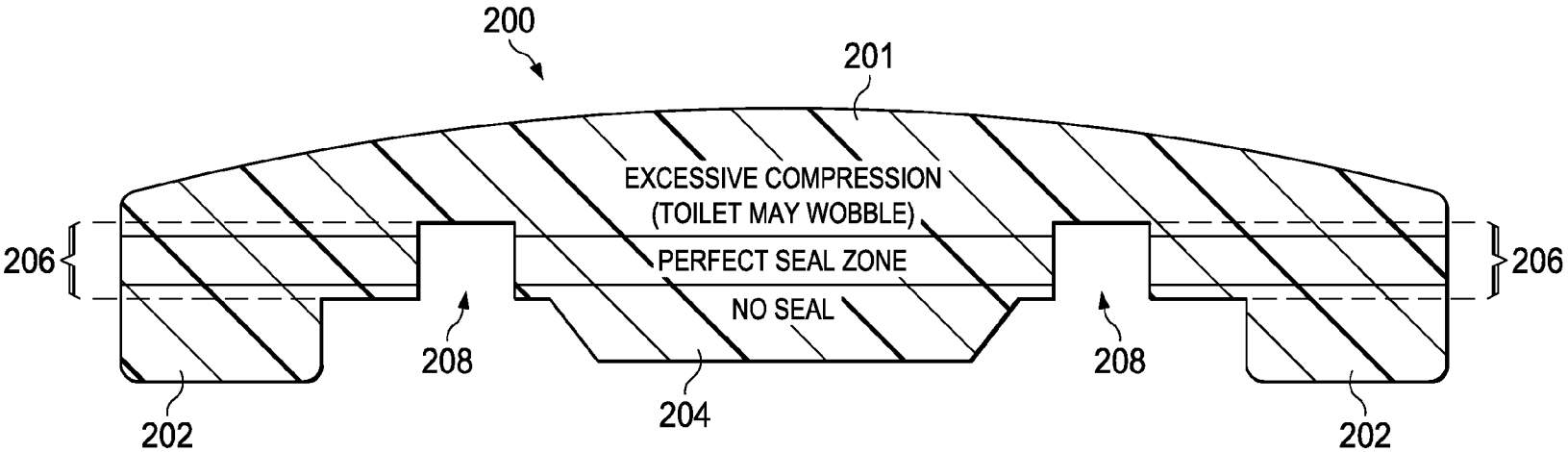
FIG. 2 depicts a front view of a full toilet installation aid in accordance with one embodiment of the present disclosure.

FIG. 2 depicts a front view of a full toilet installation aid 200 in accordance with one embodiment of the present disclosure. Like the full toilet installation aid 100 depicted in FIG. 1, the full toilet installation aid 200 may comprise a generally rectangular body 201, two outer protrusions 202, an inner protrusion 204, notches 208 separating the outer protrusions 202 and the inner protrusion 202, and indicators 206.

However, unlike the full toilet installation aid 100, the indicators 206 on the full toilet installation aid 200 may comprise line and text markings on both the outer protrusions 202 and the inner protrusion 204 proximate to the notches 208. The indicators 206 may be spaced a predetermined distance from a lower edge of the outer protrusions 202 so that the indicators 206 indicate a distance from the surface of a finished floor when the toilet installation aid 200 is in use. The line and text markings may comprise one or more colors that indicate zones of no seal (lower zone), perfect seal (middle zone), or excessive compression (upper zone) of the toilet seals when the toilet flange and the toilet bowl are connected.

Figure 3:
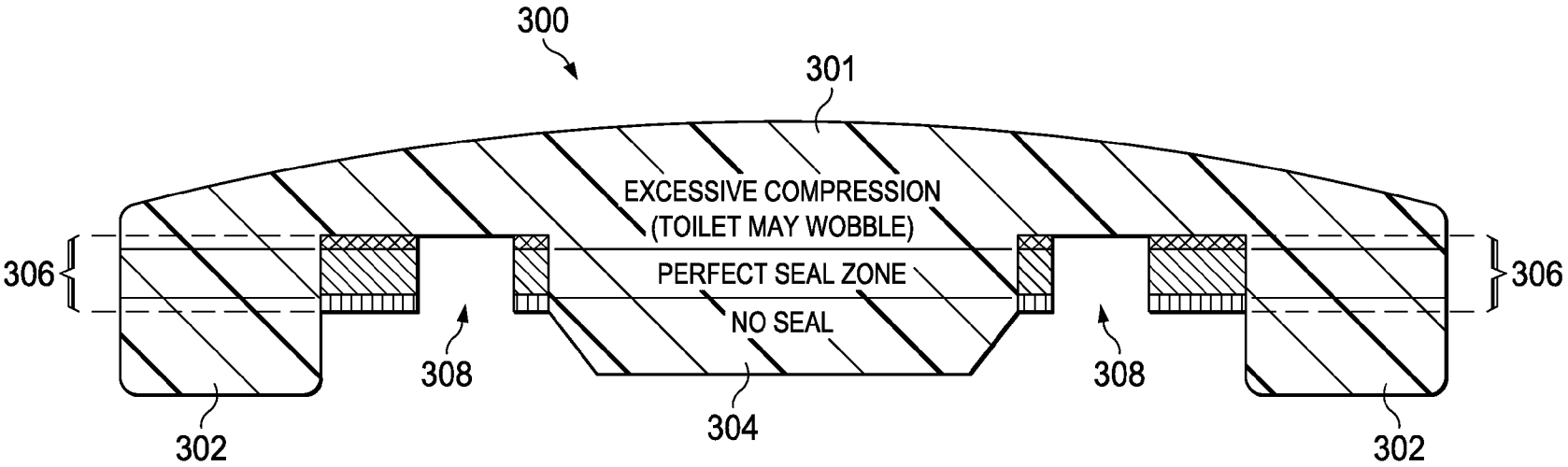
FIG. 3 depicts a front view of a full toilet installation aid in accordance with one embodiment of the present disclosure.

FIG. 3 depicts a front view of a full toilet installation aid 300 in accordance with one embodiment of the present disclosure. Like the full toilet installation aid 100 depicted in FIG. 1 and the full toilet installation aid 200 depicted in FIG. 2, the full toilet installation aid 300 may comprise a generally rectangular body 301, two outer protrusions 302, an inner protrusion 304, notches 308 separating the outer protrusions 302 and the inner protrusion 302, and indicators 306.

The indicators 306 may comprise a combination of colored and text markings on the outer protrusions 302 and the inner protrusion 304 proximate to the notches 308. The indicators 306 may be spaced a predetermined distance from a lower edge of the outer protrusions 302 so that the indicators 306 indicate a distance from the surface of a finished floor when the toilet installation aid 300 is in use. The colored and text markings may comprise one or more colors and/or text that indicate zones of no seal (lower zone), perfect seal (middle zone), or excessive compression (upper zone) of the toilet seals when the toilet flange and the toilet bowl are connected.

Figure 4:
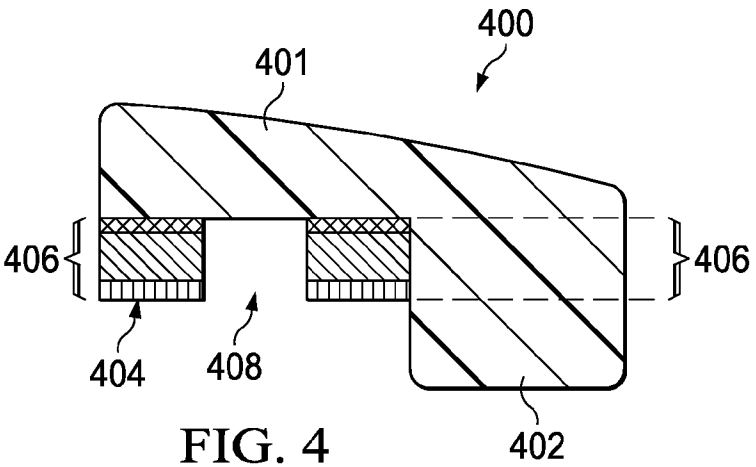
FIG. 4 depicts a front view of a half toilet installation aid in accordance with one embodiment of the present disclosure.

FIG. 4 depicts a front view of a half toilet installation aid 400 in accordance with one embodiment of the present disclosure. The half toilet installation aid 400 may comprise a body 401 operable to allow a user to determine what size and/or quantity of seals are needed to create a suitable seal between a toilet flange and a toilet. Extending from a lower edge of the body 401, the half toilet installation aid 400 may comprise an outer protrusion 402 and an inner protrusion 404. The outer protrusion 402 and the inner protrusion 404 may be separated by a notch 408 within the body 401. The outer protrusion 402 may be operable to rest on a surface of a finished floor (not shown).

Surrounding the notch 408, the body 401 may comprise a plurality of indicators 406 that assist the user in determining the size and/or quantity of seals need to created a suitable seal between the toilet flange and the toilet. The indicators 406 may comprise one or more different color and/or text markings on the outer protrusion 402 and the inner protrusion 404 proximate to the notch 408. The indicators 406 may be spaced a predetermined distance from a lower edge of the outer protrusions 402 so that the indicators 406 indicate a distance from the surface of a finished floor when the toilet installation aid 400 is in use. The colored and/or text markings may comprise one or more colors that indicate zones of no seal (lower zone), perfect seal (middle zone), or excessive compression (upper zone) of the toilet seals when the toilet flange and the toilet bowl are connected.

The half toilet installation aid 400 may be used by home owners and do-it-yourself (DIY) installers who have some experience installing toilets and professional plumbers. The outer protrusions 402 may allow the user to rest the outer protrusion 402 on the surface of the finished floor, thereby minimizing wobble of the half toilet installation aid 400. Further, the plurality of indicators 406 may allow the user to look at the markings from several different angles so that the user may be sure when determining the size and/or number of seals required for a proper seal between the toilet flange and the toilet.

Figure 5:
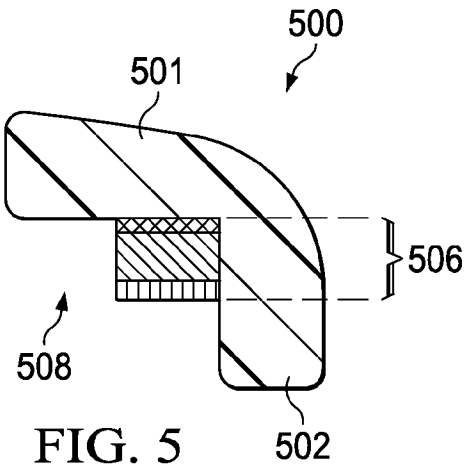
FIG. 5 depicts a front view of a quarter toilet installation aid in accordance with one embodiment of the present disclosure.

FIG. 5 depicts a front view of a quarter toilet installation aid 500 in accordance with one embodiment of the present disclosure. The quarter toilet installation aid 500 may comprise a body 501 operable to allow a user to determine what size and/or quantity of seals are needed to create a suitable seal between a toilet flange and a toilet. Extending from a lower edge of the body 501, the quarter toilet installation aid 500 may comprise an outer protrusion 502 proximate to a elbow recess 508. The outer protrusion 502 may be operable to rest on a surface of a finished floor (not shown).

Surrounding the elbow recess 508, the body 501 may comprise indicators 506 that assist the user in determining the size and/or quantity of seals need to created a suitable seal between the toilet flange and the toilet. The indicators 506 may comprise one or more different color markings and/or text on the outer protrusion 502 proximate to the elbow recess 508. The indicators 506 may be spaced a predetermined distance from a lower edge of the outer protrusions 502 so that the indicators 506 indicate a distance from the surface of a finished floor when the toilet installation aid 500 is in use. The colored markings and/or text may comprise one or more colors that indicate zones of no seal (lower zone), perfect seal (middle zone), or excessive compression (upper zone) of the toilet seals when the toilet flange and the toilet bowl are connected.

The quarter toilet installation aid 500 may be used by professional plumbers or do-it-yourselfers (DIY) with plumbing experience. The outer protrusions 502 may allow the user to rest the outer protrusion 502 on the surface of the finished floor, thereby minimizing wobble of the quarter toilet installation aid 500.

Figure 6:
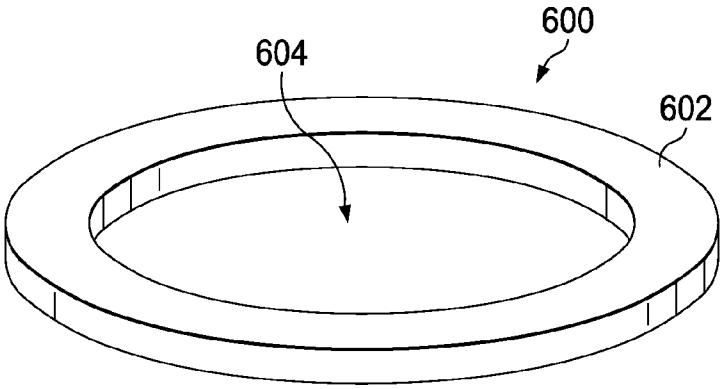
FIG. 6 depicts a perspective view of a toilet seal.

FIG. 6 depicts a perspective view of a toilet seal 600. The toilet seal 600 may comprise a ring-like body 602 and a central aperture 604 or opening. The toilet seal 600 may be sized to be used in combination with the spacing of the indicators of the toilet installation aids 100, 200, 300, 400, and 500, as depicted in FIGS. 1-5, so that the user knows how many of a particular size of toilet seal 600 are needed to create a proper seal between the toilet flange and the toilet bowl. The toilet seal 600 may be made from rubber, polymers, wax, foam, clay, Play-Doh®, or the like. In a preferred embodiment, the toilet seal 600 may be made from ethylene propylene diene rubber (EPDM) foam. Generally, the toilet seal 600 may be slightly compressible when the toilet bowl is connected to the toilet flange.

Figure 7:
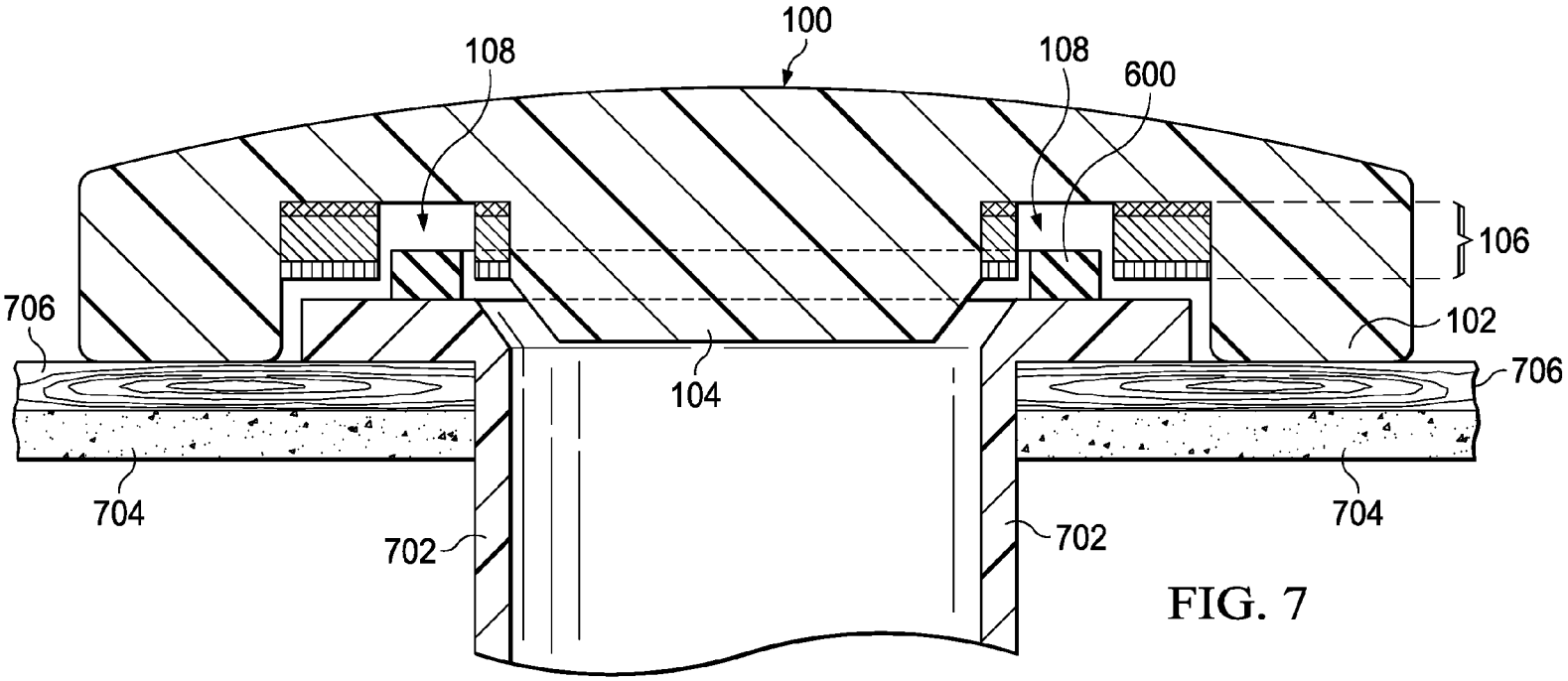
FIG. 7 depicts a profile view of the toilet installation aid of FIG. 1 in operation with a toilet flange over a finished floor in accordance with one embodiment of the present disclosure.

FIG. 7 depicts a profile view of the toilet installation aid 100 of FIG. 1 in operation with a toilet flange 702 over a finished floor 706 in accordance with one embodiment of the present disclosure. The finished floor 706 may be installed over a sub-floor 704 and the toilet flange 702 may be received within a waste drainpipe opening in the finished floor 706 and the sub-floor 704. An outwardly extending lip of the toilet flange 702 may rest on the finished floor 706. The toilet flange 702 may have a central aperture and may be generally cylindrical in shape. The toilet flange 702 may be shaped to be received within or around the waste drainpipe and the toilet flange 702 may be glued to the waste drainpipe. As shown in FIG. 7, one toilet seal 600 has been placed over the toilet flange 702 so that the apertures of the toilet seal 600 and the toilet flange 702 are in alignment.

In operation, the user may then use the full toilet installation aid 100 to determine if one toilet seal 600 is the proper number and/or thickness of toilet seals to use to ensure a proper seal between the toilet flange 702 and the toilet bowl (not shown). The full toilet installation aid 100 may be centered over the seal 600, toilet flange 702, and drainpipe so that the inner protrusion 104 is first received within the aperture of the toilet seal 600 and then received within the central aperture of the toilet flange 702. The inner protrusion 104 may be sized and shaped to properly be received within the apertures of both the toilet seal 600 and the toilet flange 702. The outer protrusions 102 may be operable to rest on the surface of the finished floor 706. The user can then use the indicators 106 to determine if the current toilet seal 600 would create a proper seal between the toilet flange 702 and the toilet bowl. As shown in FIG. 7, when the outer protrusions 102 of the toilet installation aid 100 are resting on the surface of the finished floor 706, a top surface of the single toilet seal 600 is properly within the zone of perfect seal, as indicated by the colored markings comprising the indicators 106. Because the top surface of the toilet seal 600 is within the zone of perfect seal on the toilet installation aid 100, the single toilet seal 600 may be used to seal the toilet flange 702 to the toilet. As will be depicted in later Figures, if a single toilet seal 600 did not fall within the zone of perfect seal markings of the indicator 106, different sizes and/or numbers of toilet seals would be needed to ensure that the top surface of the upper toilet seal does fall within the zone of perfect seal markings of the indicator 106.

Figure 8:
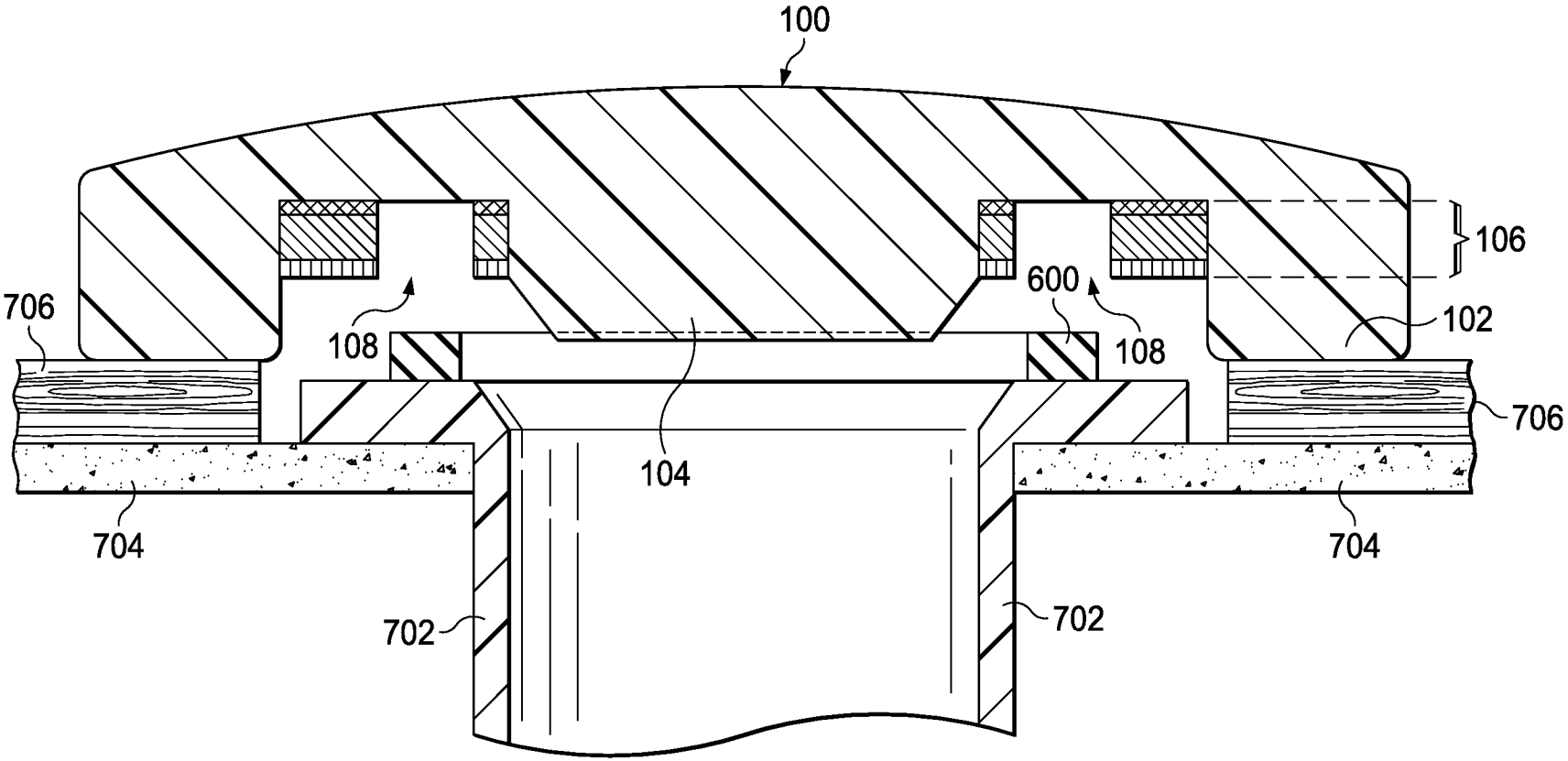
FIG. 8 depicts a profile view of the toilet installation aid of FIG. 1 in operation with a toilet flange over a sub-floor in accordance with one embodiment of the present disclosure.

FIG. 8 is a profile view of the toilet installation aid 100 of FIG. 1 in operation with the toilet flange 702 installed over the sub-floor 704 in accordance with one embodiment of the present disclosure. The finished floor 706 may be installed over a sub-floor 704 and the toilet flange 702 may be received within a waste drainpipe opening in the sub-floor 704. An outwardly extending lip of the toilet flange 702 may rest on the sub-floor 704. The toilet flange 702 may have a central aperture and may be generally cylindrical in shape. The toilet flange 702 may be shaped to be received within or around the waste drainpipe and the toilet flange 702 may be glued to the waste drainpipe. As shown in FIG. 8, one toilet seal 600 has been placed over the toilet flange 702 so that the apertures of the toilet seal 600 and the toilet flange 702 are in alignment.

In operation, the user may then use the full toilet installation aid 100 to determine if one toilet seal 600 number and/or thickness of toilet seals to ensure a proper seal between the toilet flange 702 and the toilet bowl (not shown). The full toilet installation aid 100 may be centered over the seal 600, toilet flange 702, and drainpipe so that the inner protrusion 104 is first received within the central aperture of the toilet seal 600 and then received within the central aperture of the toilet flange 702. The inner protrusion 104 may be sized and shaped to properly be received within the central apertures of both the toilet seal 600 and the toilet flange 702. The outer protrusions 102 may be operable to rest on the surface of the finished floor 706. The ring-like toilet seal 600 may be received within the notches 108. The user can then use the indicators 106 to determine if the current toilet seal 600 would create a proper seal between the toilet flange 702 and the toilet. As shown in FIG. 8, when the outer protrusions 102 of the toilet installation aid 100 are resting on the surface of the finished floor 706, a top surface of the single toilet seal 600 is well below the zone of perfect seal, as indicated by the colored markings comprising the indicators 106. Because the top surface of the toilet seal 600 is well below the zone of perfect seal on the toilet installation aid 100, additional toilet seals and/or thicker toilet seals may be needed to create a proper seal between the toilet flange 702 and the toilet bowl.

Figure 9:
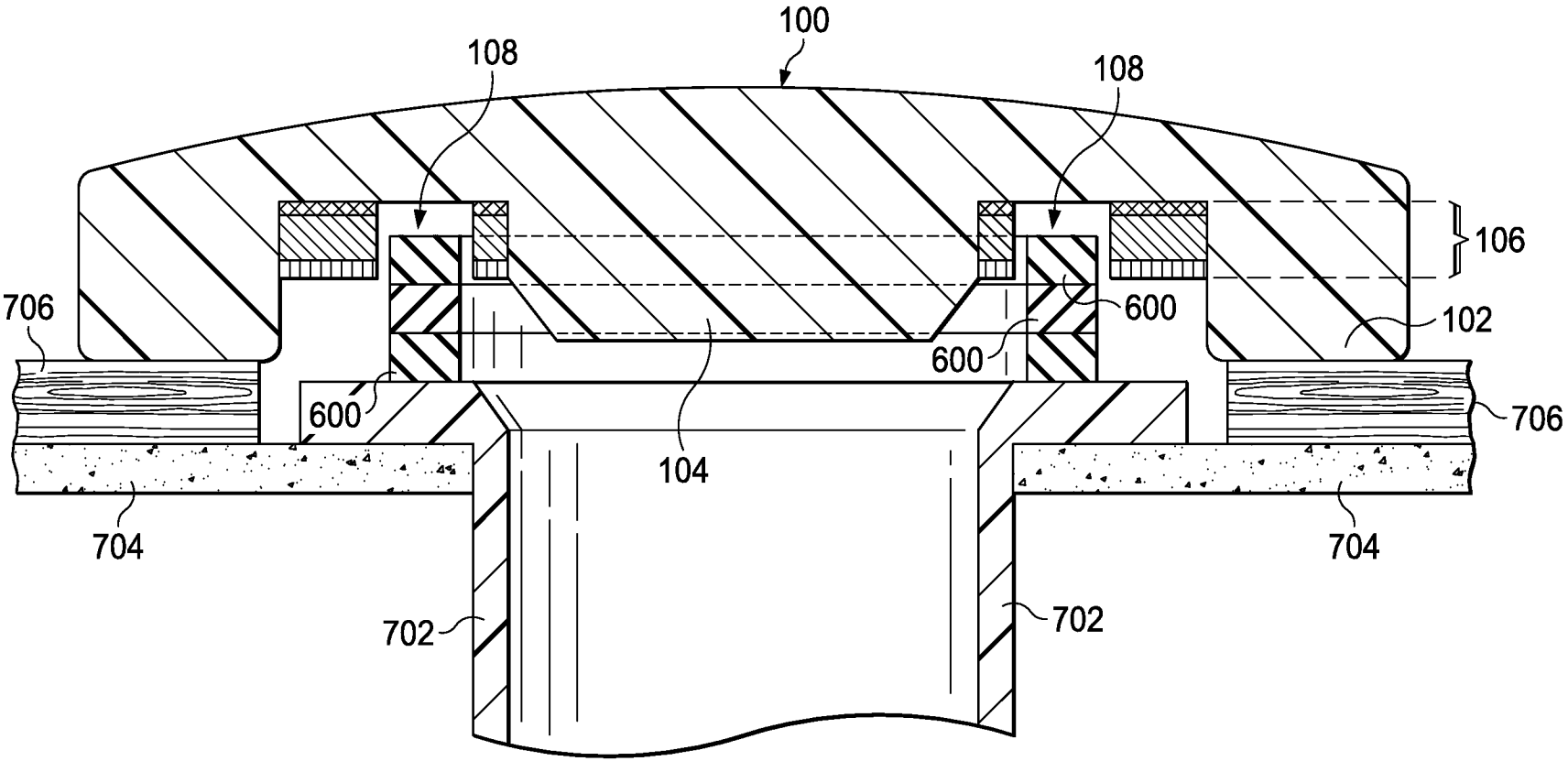
FIG. 9 depicts a profile view of the toilet installation aid of FIG. 8 with three toilet seals in accordance with one embodiment of the present disclosure.

FIG. 9 depicts a profile view of the toilet installation aid 100 of FIG. 8 with three toilet seals 600 in accordance with one embodiment of the present disclosure. After the user determined that one toilet seal 600 was not sufficient to raise the level of the top surface of the toilet seal 600 within the zone of perfect seal, as indicated by the colored markings comprising the indicators 106, the user may add a second toilet seal 600 on top of the first toilet seal 600. As shown in FIG. 9, a top surface of the second toilet seal 600 is still below the zone of perfect seal, as indicated by the colored markings comprising the indicators 106. The user may then add a third toilet seal 600 on top of the first and second toilet seals 600. After a third toilet seal 600 is added and each toilet seal 600 is received within the notches 108, a top surface of the third toilet seal 600 falls within the zone of perfect seal, as indicated by the colored markings comprising the indicators 106, thus indicating that there would be a proper seal between the toilet flange 720 and the toilet bowl with three toilet seals 600.

Figure 10:
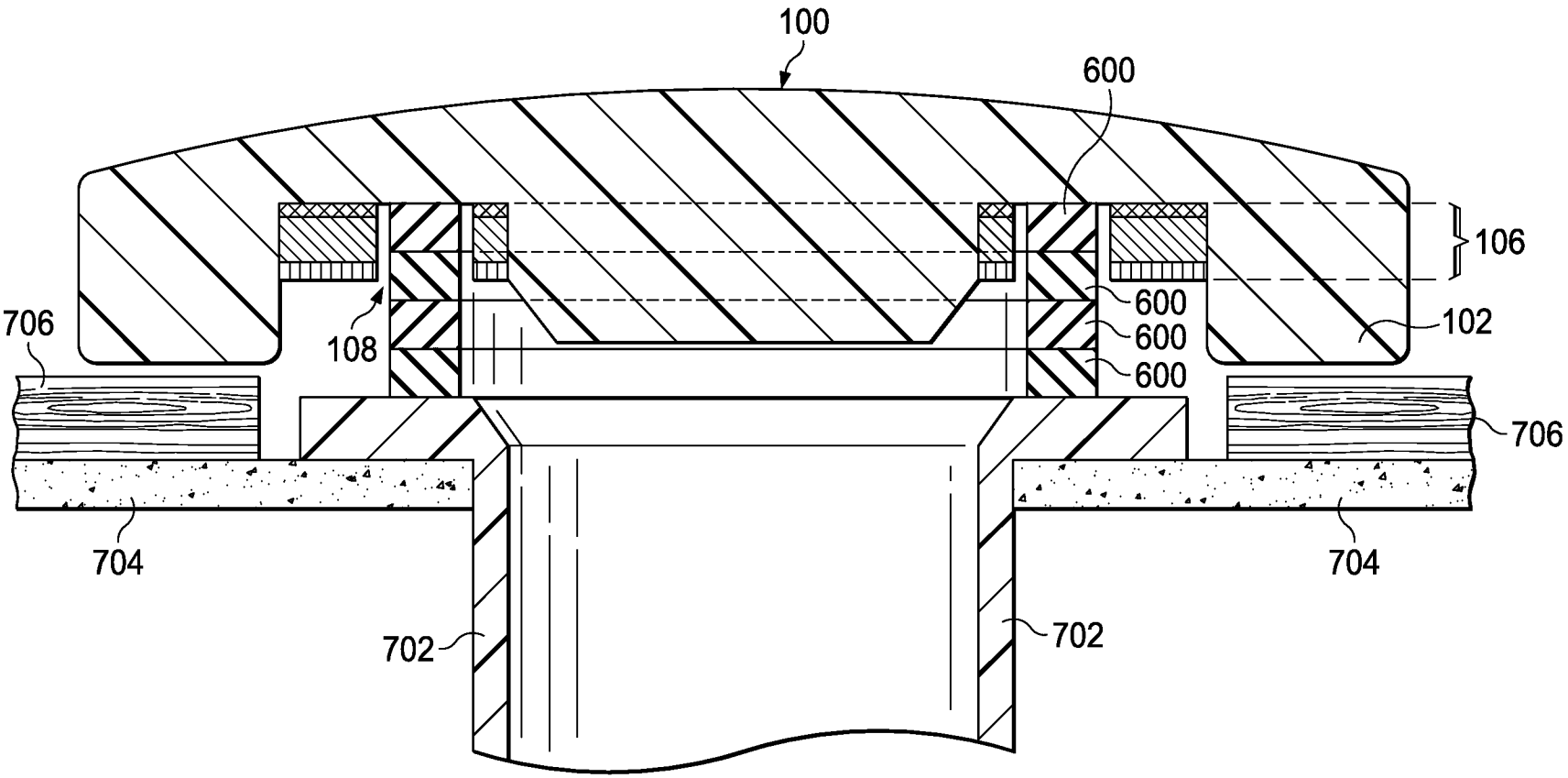
FIG. 10 depicts a profile view of the toilet installation aid of FIGS. 8 and 9 with four toilet seals in accordance with one embodiment of the present disclosure.

FIG. 10 depicts a profile view of the toilet installation aid of FIGS. 8 and 9 with four toilet seals 600 in accordance with one embodiment of the present disclosure. If a fourth toilet seal 600 is placed on top of the three toilet seals 600 depicted in FIG. 9, the outer protrusions 102 are not able to touch the surface of the finished floor 706 when upper surfaces of the notches 108 are resting on a top surface of the fourth toilet seal 600. If the outer protrusions 102 are not able to touch the surface of the finished floor 706, an installed toilet may wobble and the collective thickness of the toilet seals 600 is too thick. Therefore, the user will know that the fourth toilet seal 600 should be removed and only three toilet seals 600 should be used.

Figure 11:
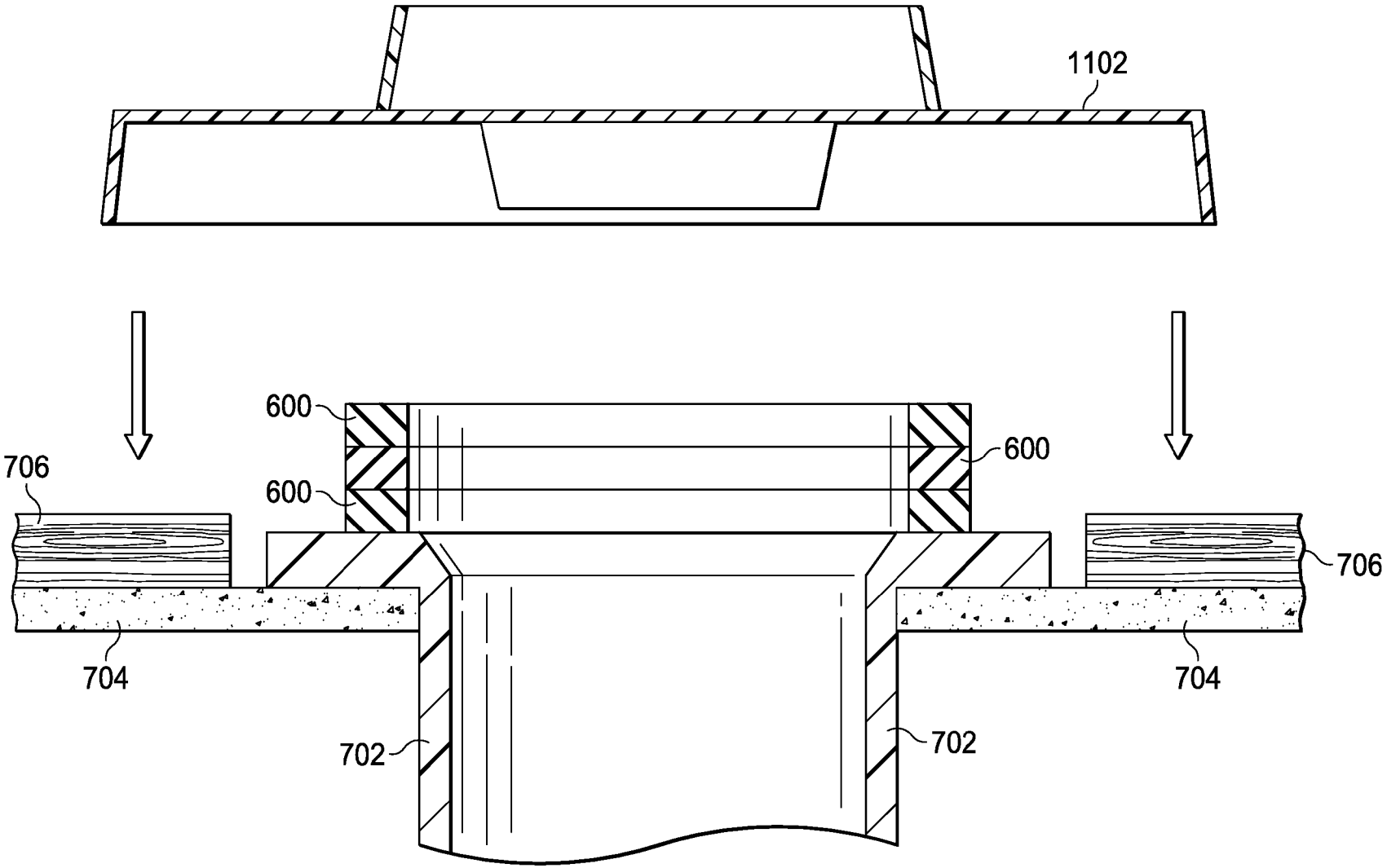
FIG. 11 depicts a profile view of a toilet being installed with a toilet flange over a sub-floor.
Figure 12:
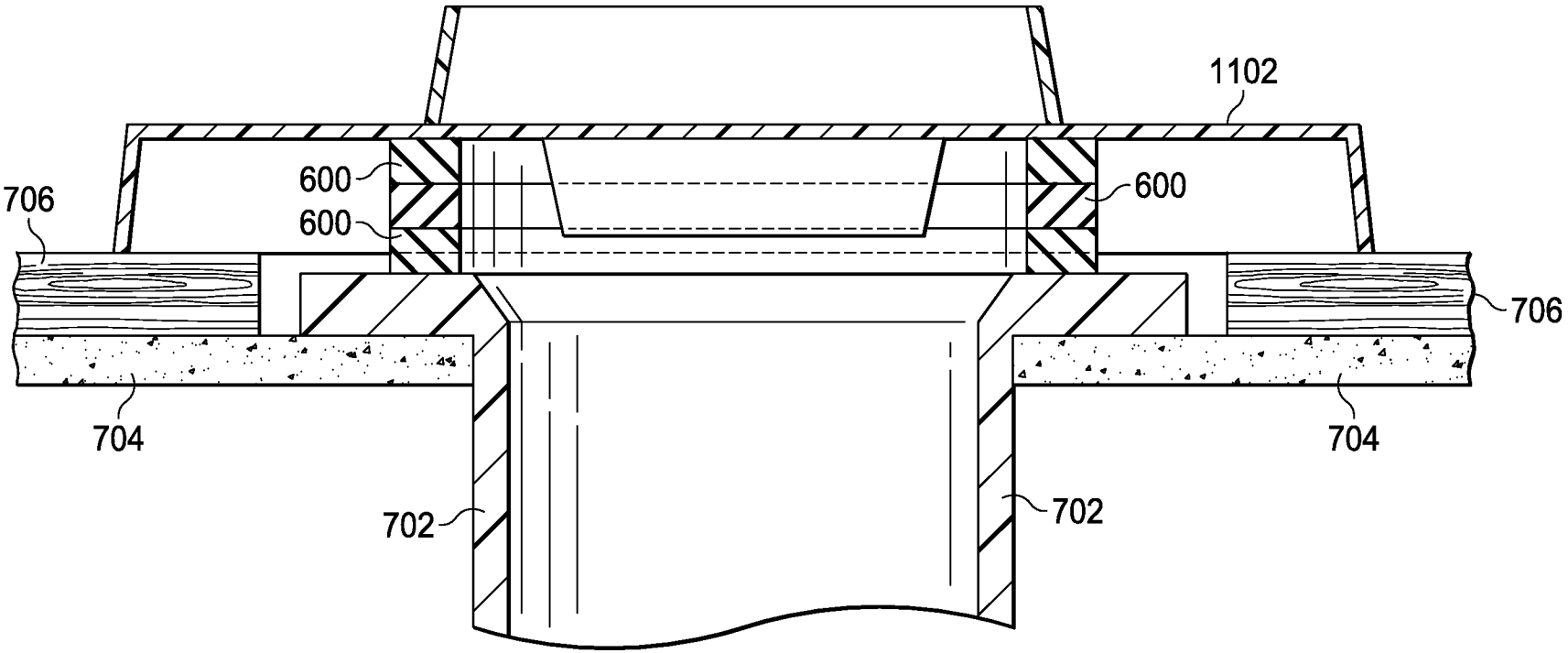
FIG. 12 depicts a profile view of the toilet of FIG. 11 installed with the toilet flange over the sub-floor.

FIG. 11 depicts a profile view of a toilet 1102 being installed on the toilet flange 702. FIG. 12 depicts a profile view of the toilet 1102 of FIG. 11 installed with the toilet flange 702. Once the toilet installation aid (not shown) has been used to determine the proper size and/or number of toilet seals 600 required to create a proper seal between the toilet 1102 and the toilet flange 702, the toilet 1102 may be lowered onto the finished floor 706. As shown in FIG. 12, when the toilet 1102 is resting on the finished floor 706, the weight of the toilet 1102 may compress the three toilet seals 600 slightly, but the use of three toilet seals 600 still creates a proper seal between the toilet 1102 and the toilet flange 702 so that there are no leaks when the toilet 1102 is used. Different toilet seals may have different levels of compression, so it is important for the user to select toilet seals that work with the spacing of the indicators on the toilet installation aid, as toilet seals of different materials may require different toilet installation aids.

The toilet installation aid may be made from paperboards, cardboards, metals, plastics, polymers, wood, or a combination thereof. The full toilet installation aid, as shown in FIGS. 1-3, may be approximately 10.00"×2.00" at its outermost dimensions. The half toilet installation aid, as shown in FIG. 4, may be approximately 3.70"×1.95" at its outermost dimensions. The quarter toilet installation aid, as shown in FIG. 5, may be approximately 2.10"×1.90" at its outermost dimensions.

While the toilet installation aid 100 depicted in FIGS. 7-10 is a full toilet installation aid, it is to be understood that a half toilet installation aid 400 or a quarter toilet installation aid 500, as depicted in FIGS. 4 and 5, respectively, may be used interchangeably.

Advantageously, by using a toilet installation aid, the correct size and/or number of toilet seals may be used each time to create a proper seal between the toilet bowl and the toilet flange. This avoids using too many toilet seals, which creates waste and may cause the toilet to wobble when installed, and also avoids using too few toilet seals, which may lead to leaks and costly repairs if the toilet bowl and the toilet flange are not properly connected and sealed during installation.

Additionally, the disclosed toilet installation aid may advantageously be used with a toilet flange that does not require one or more toilet seals in order to create a seal between the toilet flange and a toilet bowl. With a wax-less flexible toilet flange, for example, the toilet installation aid may be used to indicate whether the toilet flange has been installed and positioned at a correct height to create a seal between the toilet flange and the toilet bowl. If the toilet flange is not at the correct height, as indicated on the toilet installation aid, the toilet flange may need to be raised or one or more spacers may be needed to create a seal between the toilet flange and the toilet bowl.

It should be appreciated that the breadth and scope of the invention(s) is not limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

The invention claimed is:

1. A toilet installation aid, comprising:
a body;
at least one outer protrusion extending from the body; and
at least one indicator comprising markings on the body or on the at least one outer protrusion;
wherein the at least one outer protrusion is operable to rest on a finished flooring surface; and
wherein when the at least one outer protrusion rests on the finished flooring surface, the at least one indicator indicates the size and/or quantity of toilet seals needed to create a seal between a toilet bowl and a toilet flange.

2. The toilet installation aid of claim 1, wherein the at least one outer protrusion extends from one end and at a lower surface of the body.

3. The toilet installation aid of claim 2, further comprising two outer protrusions extending from each end and at the lower surface of the body.

4. The toilet installation aid of claim 1, further comprising an inner protrusion extending from a lower surface of the body and proximate to the at least one outer protrusion.

5. The toilet installation aid of claim 4, wherein the inner protrusion extends from a middle section at the lower surface of the body.

6. The toilet installation aid of claim 5, wherein the inner protrusion is operable to extend within a central opening of a toilet flange.

7. The toilet installation aid of claim 6, wherein the inner protrusion and the at least one outer protrusion are separated by a notch.

8. The toilet installation aid of claim 7, wherein the notch is operable to receive one or more toilet seals.

9. The toilet installation aid of claim 1, wherein the at least one indicator comprises colored markings.

10. The toilet installation aid of claim 1, wherein the at least one indicator comprises text markings.

11. The toilet installation aid of claim 1, wherein the at least one indicator indicates a zone of no seal, perfect seal, or excessive compression.

12. The toilet installation aid of claim 1, wherein the toilet installation aid is manufactured from at least one material of a group consisting of: paperboard, cardboard, metal, plastic, polymer, wood, or a combination thereof.

13. A method of using a toilet installation aid to determine the amount of gapping between a top surface of a toilet flange and a bottom surface of a toilet bowl, the method comprising:
providing a toilet installation aid, the toilet installation aid comprising:
a body;
at least one outer protrusion extending from the body; and
at least one indicator comprising markings on the body or on the at least one outer protrusion;
resting the at least one outer protrusion on a finished flooring surface; and
reading the at least one indicator when the at least one outer protrusion rests on the finished flooring surface;

wherein the at least one indicator indicates the size and/or quantity of toilet seals needed to create a seal between the toilet bowl and the toilet flange; or wherein the at least one indicator indicates whether a toilet flange should be raised or if one or more spacers is needed to create a seal between a toilet bowl and the toilet flange.

14. The method of claim 13, wherein the at least one outer protrusion extends from one end and at a lower surface of the body.

15. The method of claim 13, further comprising an inner protrusion extending from a lower surface of the body and proximate to the at least one outer protrusion.

16. The toilet installation aid of claim 15, wherein the inner protrusion is operable to extend within a central opening of a toilet flange.

17. The toilet installation aid of claim 15, wherein the inner protrusion and the at least one outer protrusion are separated by a notch.

18. The toilet installation aid of claim 17, wherein the notch is operable to receive one or more toilet seals.

19. The toilet installation aid of claim 13, wherein the at least one indicator indicates a zone of no seal, perfect seal, or excessive compression.

20. A toilet installation aid, comprising:

a body;

at least one outer protrusion extending from the body; and at least one indicator comprising markings on the body or on the at least one outer protrusion;

wherein the at least one outer protrusion is operable to rest on a finished flooring surface; and wherein when the at least one outer protrusion rests on the finished flooring surface, the at least one indicator indicates whether a toilet flange should be raised or if one or more spacers is needed to create a seal between a toilet bowl and the toilet flange.

* * * * *